US006507280B2

(12) United States Patent
Tabata et al.

(10) Patent No.: US 6,507,280 B2
(45) Date of Patent: Jan. 14, 2003

(54) DEVICE FOR MOUNTING A COMMUNICATION UNIT TO A HELMET

(75) Inventors: Hajime Tabata, Saitama (JP); Yukio Miyamaru, Saitama (JP); Mutsumi Katayama, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/950,575

(22) Filed: Sep. 13, 2001

(65) Prior Publication Data

US 2002/0030589 A1 Mar. 14, 2002

(30) Foreign Application Priority Data

Sep. 13, 2000 (JP) ..... 2000-278186

(51) Int. Cl.[7] ..... G08B 23/00

(52) U.S. Cl. ..... 340/573.1; 2/6.2; 455/90; 455/575; 340/539; 340/693.9

(58) Field of Search ..... 340/539, 573.1, 340/693.5, 693.9; 455/90, 575; 2/5, 6.1, 6.2

(56) References Cited

U.S. PATENT DOCUMENTS 4,949,378 A * 8/1990 Mammone ..... 380/9
5,615,410 A * 3/1997 Demars ..... 455/90
6,101,256 A * 8/2000 Steelman ..... 381/91

FOREIGN PATENT DOCUMENTS

JP 62-155535 10/1987

* cited by examiner

*Primary Examiner*—Daryl Pope
(74) *Attorney, Agent, or Firm*—Birch, Stewart, Kolasch & Birch, LLP

(57) ABSTRACT

To provide a device capable of firmly mounting a radio communication unit to a helmet in a simple manner without impairing the beauty and handleability of the helmet when the radio communication unit is detached from the helmet. The device for mounting a radio communication unit to a helmet includes a pair of couplers having a chucking function and a pair of magnetic connectors having a magnetically chucking function. The pair of magnetic connectors are provided with electrical contacts adapted to turn conductive when in a chucked condition. Furthermore, one of the pair of couplers and one of the pair of magnetic connectors is disposed on an outer surface of the helmet, while the other of the pair of couplers and the other of the pair of magnetic connectors is disposed on a main surface of the radio communication unit.

22 Claims, 3 Drawing Sheets

DEVICE FOR MOUNTING A COMMUNICATION UNIT TO A HELMET

BACKGROUND OF THE INVENTION

1. Field of the Invention

The present invention relates to a device for mounting a communication unit to a helmet. In particular, the present invention is directed to a device which is capable of mounting a communication unit to a helmet firmly in a simple manner without impairing the beauty and handleability of the helmet.

2. Description of Background Art

A technique of equipping a helmet of each passenger with a speaker and a microphone (hereinafter both may be referred to generically as "head set") and mounting a radio communication unit having a transmitting and receiving function to the helmet removably has been disclosed in, for example, in a microfilm of Japanese Utility Model Laid Open No. 155535/1987. In the above document, conversation between passengers on a saddle type vehicle such as a two-wheeled motor vehicle or between a passenger on one saddle type vehicle with another passenger on another like vehicle is possible In the above technique, it has been proposed to use Magic Tape® as a method for mounting a radio communication unit to a helmet.

With regard to mounting a radio communication unit to a helmet, there also has been proposed, other than the use of the Magic Tape® just referred to above, a method wherein a pair of detachable metallic mounting pieces are attached to the helmet and the communication unit, respectively, (e.g., HELMET COM MR-403 of MOTO FIZZ brand manufactured (1997) by TANAX CORPORATION).

In the above fixing method using Magic Tape® the tape becomes exposed to the outer surface of the helmet when the communication unit is not mounted to the helmet. This decreases the beauty of the helmet. Furthermore, with Magic Tape®, it is impossible to ensure an electrical connection between the helmet and the communication unit. Accordingly, it is necessary to provide a separated electrical connecting mechanism.

In the foregoing fixing method using metallic mounting pieces, the metallic pieces have projections, or exposed concave and convex surfaces are present on the outer surface of the helmet when the communication unit is not attached to the helmet. Accordingly, in addition to the beauty of the helmet being impaired, handling of the helmet must be done with care, since the metallic pieces may be caught in surrounding articles while carrying the helmet. Furthermore, even if metallic mounting pieces are used, it has still been necessary to separately provide a device for electric connection between the head set and the communication unit.

SUMMARY OF THE INVENTION

It is an object of the present invention to solve the above-mentioned problems of the background art and provide a device capable of mounting a communication unit to a helmet firmly in a simple manner without impairing the beauty and handleability of the helmet even when the communication unit is not mounted to the helmet.

According to the present invention, for achieving the above-mentioned object, there is provided a device for mounting a communication unit to a helmet, including a pair of magnetic couplers having a magnetically chucking function and a pair of magnetic connectors having a magnetically chucking function and provided with electrical contacts adapted to turn conductive in a chucking condition. One of the magnetic couplers and one of the magnetic connectors is disposed on the helmet side, and the other of the magnetic couplers and the other of the magnetic connectors is disposed on the main surface of the communication unit.

With this configuration, Magic Tape® or projections of metallic mounting pieces, which impair the beauty of the helmet, are not exposed to the helmet surface even when the communication unit is not attached to the helmet. Accordingly, the beauty of the helmet is not spoiled and it becomes easier to handle the helmet while carrying it.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
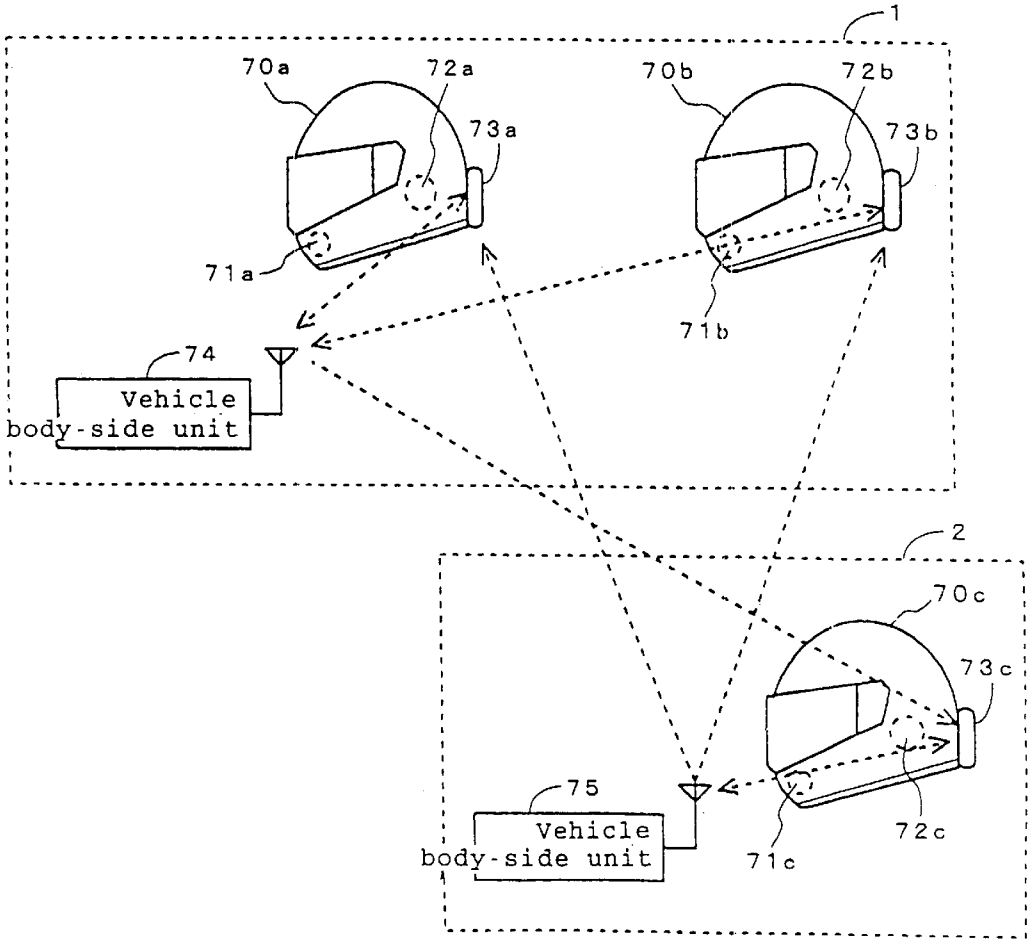
FIG. 1 is a schematic illustration of a communication method using a vehicular radio communication system to which the present invention is applied.

The present invention will be described in detail hereinunder with reference to the accompanying drawings. FIG. 1 schematically illustrates a communication method based on a vehicular radio communication system to which the present invention is applied. Reference will be made below to an example in which communication is made among three passengers riding separately on two vehicles 1 and 2.

A helmet 70 which each passenger wears is equipped with a microphone 71, a loudspeaker 72, and a radio communication unit 73. The radio communication unit 73 is attached to the rear central part of the helmet 70 through a detachable fixing member. Vehicle body-side units 74 and 75 are respectively mounted on the vehicles 1 and 2 for radio communication with the radio communication units 73.

With such a configuration, for communication between passengers on vehicle 1, i.e., between a rider and a fellow passenger, a voice of the rider, for example, is detected by a microphone 71*a* and is converted to an audio signal. The signal is then transferred to a radio communication unit 73*a*. The radio communication unit 73*a* of the rider communicates with a radio communication unit 73*b* of the fellow passenger directly or indirectly through the vehicle body-side unit 74 mounted on the vehicle concerned.

For communication between a passenger on the vehicle 1 and a passenger on the vehicle 2, a radio wave emitted from the radio communication unit 73*a* of the rider on the vehicle 1 for example is received by the vehicle body-side unit 74 on the vehicle 1, in which it is amplified and then transmitted again. The radio wave thus transmitted from the vehicle body-side unit 74 is received by the radio communication unit, or a radio transmitter/receiver, 73*b* of the follow passenger and is also received by a radio communication unit 73*c* of the rider on the vehicle 2, then is reproduced by the loudspeaker 72*c*.

A radio wave emitted from the radio communication unit 73 of the rider on the vehicle 2 is received by the vehicle body-side unit 75 on the vehicle 2, in which it is amplified and then transmitted again. The radio wave thus transmitted from the vehicle body-side unit 75 is received by the radio communication units 73*a* and 73*b* of the rider and fellow passenger on the vehicle 1 and is reproduced by loudspeakers 72*a* and 72*b*.

The way of communication is not limited to the above. All communications between the vehicles 1 and 2 may be done through the vehicle body-side units 74 and 75. In this case, a voice of the rider on the vehicle 2 is transferred to the rider (radio communication unit 73*a*) and fellow passenger (radio communication unit 73*b*) on the vehicle 1 via the radio communication unit 73 and the vehicle body-side units 75, 74.

Figure 2:
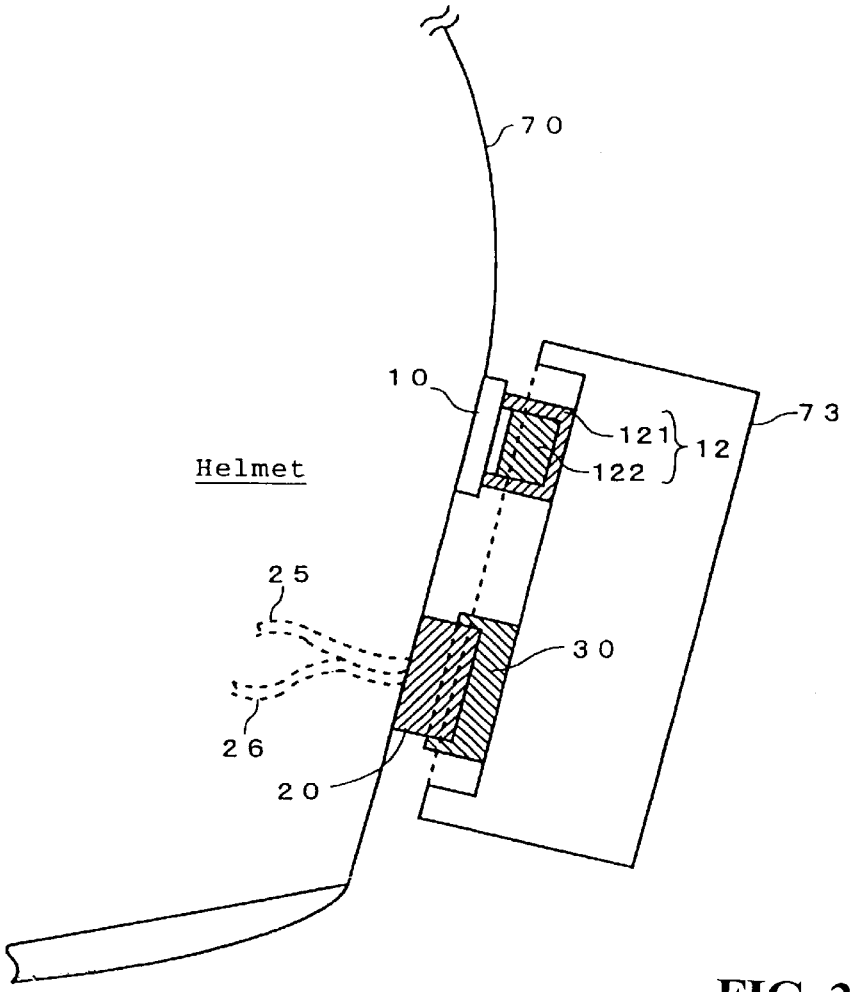
FIG. 2 is a side view of the first embodiment of the present invention.
Figure 3:
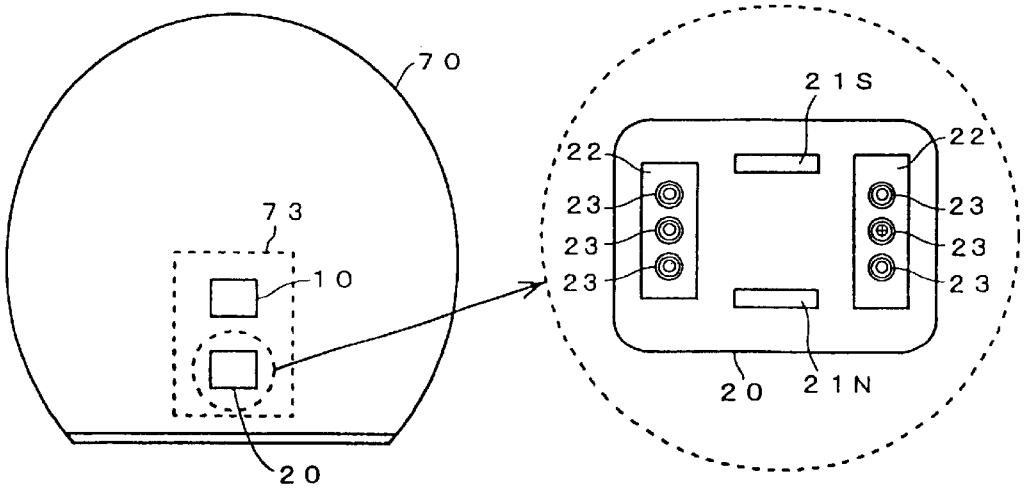
FIG. 3 is a rear view of a helmet with a radio communication unit detached therefrom.
Figure 4:
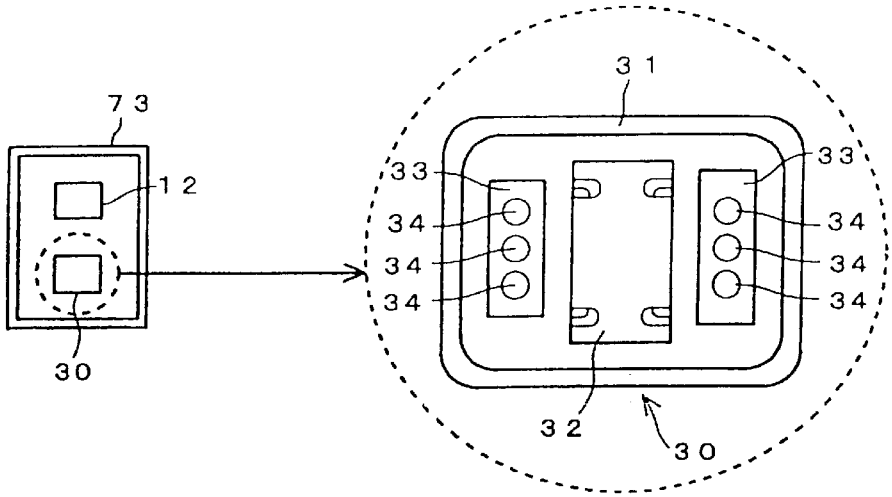
FIG. 4 is a plan view of a helmet-side main surface of a radio communication unit according to the present invention.
Figure 5:
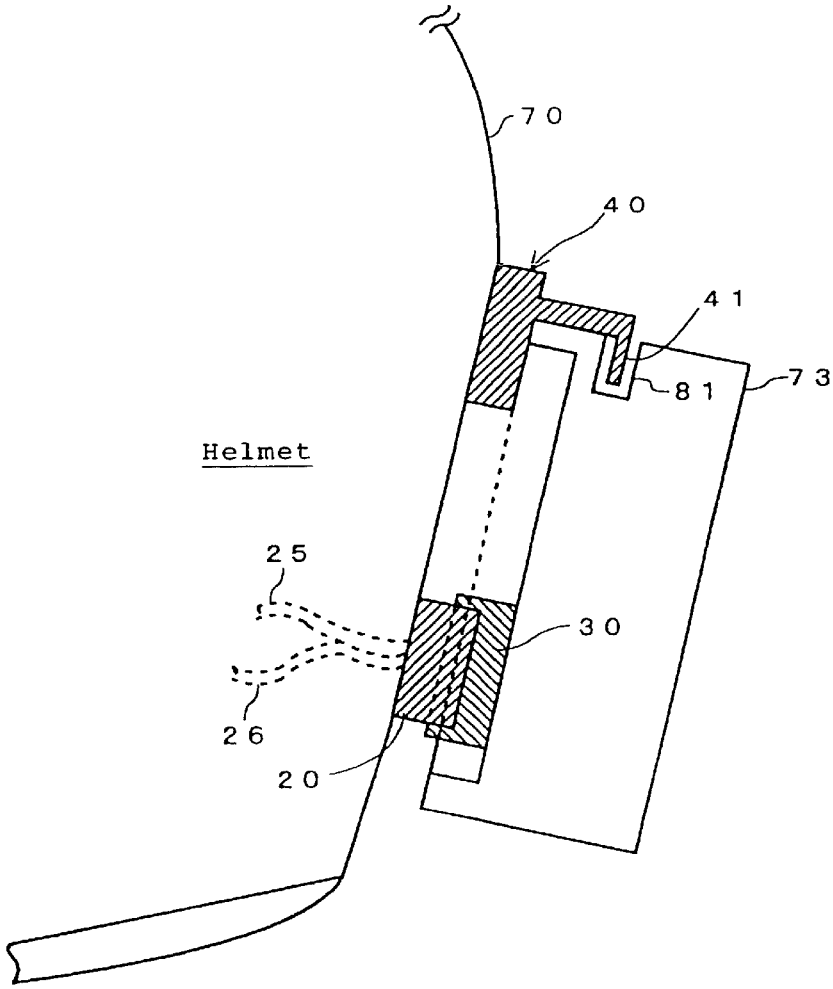
FIG. 5 is a side view of the second embodiment of the present invention.

FIG. 2 is a sectional side view showing a method for mounting the radio communication unit 73 to the helmet 70 in this embodiment. FIG. 3 is a rear view of the helmet with the radio communication unit 73 detached therefrom. FIG. 4 is the plan view of the helmet-side main surface of the radio communication unit 73.

As shown in FIG. 3, an iron plate 10 as a magnetic plate and a magnetside socket 20 of a magnetic connector are fixed to lower positions of the rear side of the helmet 70 so as to be spaced a predetermined distance vertically. It is preferable that an exposed portion of the iron plate 10 be painted in the same color as the helmet 70.

As shown on a larger scale on the right-hand side of FIG. 3, an S-pole iron piece 21S, an N-pole iron piece 21N, and plural electrodes 23 exposed to the bottom of a recess 22 are provided on a connecting surface of the magnet-side socket 20. The electrodes 23 of the magnet-side socket 20 are connected to the microphone 71 and loudspeaker 72 through lead wires 25 and 26.

As shown in FIG. 4, a magnet 12 which constitutes one pair of magnetic couplers together with the iron plate 10 and a magnetic material-side socket 30 which constitutes one pair of magnetic connectors together with the magnet-side socket 20 are fixed to the helmet-side main surface of the radio communication unit 73 so as to be spaced a predetermined distance vertically. As shown in FIG. 2, the magnet 12 is made up of a permanent magnet 122 and a magnet core 121 which covers side faces and the rear side of the permanent magnet 122, so that all of its magnetic force acts on the iron plate 10 of the helmet.

As shown on a larger scale in FIG. 4, an annular rib 31, a magnetic plate 32 and electrodes 35 are provided on the connecting surface of the magnetic material-side socket 30. The annular rib 31 is erected along an outer periphery of the magnetic material-side socket 30. The magnetic plate 32 is fixed to a bottom of the magnetic material-side socket 30. Furthermore, the electrodes 34 are exposed to upper surfaces of island-like portions 33 which are raised from the bottom of the magnetic material-side socket 30.

With such a configuration, when the radio communication unit 73 is to be mounted to the helmet 70, the magnet-side socket 20 of the helmet 70 is fitted in the annular rib 31 of the magnetic material-side socket 30 in the radio communication unit 73 and then both sockets are established in their positions so as to be chucked and fixed mechanically by magnetism.

At this time, a relative positional relation between the magnet-side socket 20 and the magnetic material-side socket 30, particularly, an angle in a twist direction, is defined by the annular rib 31 of the socket 30, so that both sockets can be held in a desired positional relation. As a result, the iron plate 10 of the helmet 70 and magnet 12 of the radio communication unit 73 is also held in a predetermined relation and therefore both are also coupled together magnetically.

According to this embodiment, the helmet 70 and the radio communication unit 73 are fixed together magnetically and only the iron plate 10, which is thin, small and flat, and the socket 20, which is associated with high function, are exposed to the surface of the helmet 70 when the radio communication unit 73 is not mounted, without exposure of Magic Tape® or metallic mounting pieces. Therefore, the beauty of the helmet is not deteriorated and it becomes easier to handle the helmet while carrying it.

According to this embodiment, moreover, since the helmet 70 and the radio communication unit 73 are magnetically coupled together at two places, it becomes possible to fix the radio communication unit 73 to the helmet 70 firmly in a simple manner. Furthermore, since the electrical connection between the helmet and the radio communication unit is ensured with highly reliable magnetic connectors, it becomes possible to effect a highly reliable connection.

Although in the above embodiment the magnet 12 of a magnetic coupler is composed of the permanent magnet 122 and the magnet core 121, there may be used a highly flexible plastic or resin magnet instead.

FIG. 2 is a sectional side view showing how to mount the radio communication unit 73 to the helmet 70 according to the second embodiment of the present invention, in which the same reference numerals as in the previous embodiment represent the same or equivalent portions.

In this embodiment, instead of using a magnetic coupler comprising the iron plate 10 and the magnet 12, a resin damper 40 is fixed to a helmet 70, and at the beginning of the mounting work a pawl portion 41 of the resin damper 40 is inserted into a retaining hole 81 formed in the side face of a radio communication unit 73 and thereafter a magnet-side socket 20 and a magnetic material-side socket 30 are coupled together.

In this embodiment, the resin damper 40 is exposed to the surface of the helmet 70 when the radio communication unit 73 is not attached to the helmet, and therefore care must be exercised to some extent in comparison with the first embodiment, but a coupler which spoils the beauty of the helmet, such as Magic Tape, is not exposed to the surface of the helmet, that is, the beauty of the helmet is not spoiled even when the radio communication unit 73 is not attached to the helmet. Further, since the resin clamper 40 can be colored easily, if it is painted with the same color as the helmet, the presence thereof can be made less conspicuous.

Although in each of the above embodiments the present invention was applied to a radio communication system, no limitation is made thereto. Instead of the radio communication unit 73 there may be adopted a wire type communication unit and the invention may be applied to a communication system in which a wire communication unit attached to the helmet 70 and a vehicle body-side unit are wired with each other.

According to the present invention there are attained the following effects.

(1) Since Magic Tape or projections such as metallic mounting pieces are not exposed to the helmet surface even when the communication unit is not attached to the helmet, the beauty of the helmet is not spoiled and it becomes easier to handle the helmet when carrying it.

(2) Since the helmet and the communication unit are coupled together magnetically at two places, the communication unit can be fixed to the helmet firmly in a simple manner.

(3) Since the electrical connection between the helmet and the communication unit is ensured with magnetic connectors, it is possible to effect a highly reliable connection.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for mounting a communication unit to a helmet, comprising:

a pair of couplers having a chucking function;

a pair of magnetic connectors having a magnetically chucking function, each of said pair of magnetic connectors being provided with electrical contacts, said electrical contacts being conductive when said pair of magnetic connectors is in a chucked condition;

a first of said couplers and a first of said magnetic connectors are mountable on the helmet; and a second of said couplers and a second of said magnetic connectors are mountable on a main surface of said communication unit.

2. The device for mounting a communication unit to a helmet according to claim 1, wherein said first of the couplers and said first of the magnetic connectors are at least partially the same in color as an outer surface of the helmet.

3. The device for mounting a communication unit to a helmet according to claim 1, wherein said pair of couplers are magnetic couplers having a magnetically chucking function, and a first of said magnetic couplers or said first of the magnetic connectors includes a magnet.

4. The device for mounting a communication unit to a helmet according to claim 2, wherein said pair of couplers are magnetic couplers having a magnetically chucking function, and said first of the magnetic couplers or said first of the magnetic connectors includes a magnet.

5. The device for mounting a communication unit to a helmet according to claim 1, wherein said pair of couplers are magnetic couplers having a magnetically chucking function, and said second of the magnetic couplers or said second of the magnetic connectors includes a magnet.

6. The device for mounting a communication unit to a helmet according to claim 2, wherein said pair of couplers are magnetic couplers having a magnetically chucking function, and said second of the magnetic couplers or said second of the magnetic connectors includes a magnet.

7. The device for mounting a communication unit to a helmet according to claim 1, wherein said electrical contacts of said first of the pair of magnetic connectors are electrically connectable to a microphone and loudspeaker mounted in the helmet.

8. The device for mounting a communication unit to a helmet according to claim 1, wherein said pair of magnetic connectors include cooperating male and female components, said electrical contacts being located on said male and female components, and wherein the electrical contacts become conductive when the male and female components are engaged with each other.

9. The device for mounting a communication unit to a helmet according to claim 1, wherein one of said pair of magnetic connectors includes a rib extending along a periphery thereof, said rib for engaging an outer periphery of the other of said pair of magnetic connectors to hold said pair of magnetic connectors in a mechanically chucked condition.

10. The device for mounting a communication unit to a helmet according to claim 1, wherein said pair of couplers are restraining members adapted to engage and restrain each other.

11. The device for mounting a communication unit to a helmet according to claim 10, wherein said restraining members include a pawl on one of said restraining members for engaging with a retaining hole on the other of said restraining members.

12. A communication system, comprising:

a vehicle communication unit mounted on a vehicle;

a helmet, said helmet including a microphone and a loudspeaker mounted therein;

a helmet communication unit; and a mounting device for detachably connecting said helmet communication unit to said helmet, said mounting device including:

a pair of couplers having a chucking function;

a pair of magnetic connectors having a magnetically chucking function, each of said pair of magnetic connectors being provided with electrical contacts, said electrical contacts being conductive when said pair of magnetic connectors is in a chucked condition;

a first of said couplers and a first of said magnetic connectors are mounted on the helmet; and a second of said couplers and a second of said magnetic connectors are mounted on a main surface of said communication unit.

13. The communication system according to claim 12, wherein said first of the couplers and said first of the magnetic connectors are at least partially the same in color as an outer surface of the helmet.

14. The communication system according to claim 12, wherein said pair of couplers are magnetic couplers having a magnetically chucking function, and a first of said magnetic couplers or said first of the magnetic connectors includes a magnet.

15. The communication system according to claim 13, wherein said pair of couplers are magnetic couplers having a magnetically chucking function, and said first of the magnetic couplers or said first of the magnetic connectors includes a magnet.

16. The communication system according to claim 12, wherein said pair of couplers are magnetic couplers having a magnetically chucking function, and said second of the magnetic couplers or said second of the magnetic connectors includes a magnet.

17. The communication system according to claim 13, wherein said pair of couplers are magnetic couplers having a magnetically chucking function, and said second of the magnetic couplers or said second of the magnetic connectors includes a magnet.

18. The communication system according to claim 12, wherein said electrical contacts of said first of the pair of magnetic connectors are electrically connected to said microphone and said loudspeaker mounted in said helmet.

19. The communication system according to claim 12, wherein said pair of magnetic connectors include cooperating male and female components, said electrical contacts being located on said male and female components, and wherein the electrical contacts become conductive when the male and female components are engaged with each other.

20. The communication system according to claim 12, wherein one of said pair of magnetic connectors includes a rib extending along a periphery thereof, said rib for engaging an outer periphery of the other of said pair of magnetic connectors to hold said pair of magnetic connectors in a mechanically chucked condition.

21. The communication system according to claim 12, wherein said pair of couplers are restraining members adapted to engage and restrain each other.

22. The communication system according to claim 21, wherein said restraining members include a pawl on one of said restraining members for engaging with a retaining hole on the other of said restraining members.

* * * * *